United States Patent [19]

Kobayashi

[11] 3,948,002

[45] Apr. 6, 1976

[54] VIBRATORY FINISHING APPARATUS

[75] Inventor: Hisamine Kobayashi, Nagoya, Japan

[73] Assignee: Kabushiki Kaisha Shikishima Tipton, Nagayo, Japan

[22] Filed: Apr. 14, 1975

[21] Appl. No.: 568,099

[30] Foreign Application Priority Data

July 11, 1974 Japan ..... 49-79343

[52] U.S. Cl. ..... 51/163 V; 259/29

[51] Int. Cl.² ..... B24B 31/00

[58] Field of Search..... 51/163 R, 163 V; 241/175; 259/2, 29

[56] References Cited

UNITED STATES PATENTS

| | | | |
|---|---|---|---|
| 3,633,321 | 1/1972 | Rise | 51/163 V |
| 3,676,958 | 7/1972 | Garland | 51/163 V |
| 3,771,266 | 11/1973 | Kobayashi | 51/163 V |

*Primary Examiner*—Harold D. Whitehead

*Attorney, Agent, or Firm*—Wenderoth, Lind & Ponack

[57] ABSTRACT

An improved vibratory finishing apparatus with a vibratory finishing tub formed like a hollow circular annular trough disposed in a horizontal, ascending- or descending-slope arrangement, the tub having therein a limited accumulating space defined by a known stationary dam of triangular shape at the bottom, a known movable flap member provided with an anti-backflow member thereon, at least one guide plate for guiding a mass including workpieces and media into the space and preventing the backflow of the mass, and at least one closure rigidly or removably mounted on upper open portions of the tub and for controlling the flow of the mass moving up in the space. As a flow of the mass is pushed into the space, it is accumulated to form an accumulated mass which is then pushed out onto the mass separating device or sieve. The space so constructed serves to prevent the backflow of the accumulated mass, and ensures an increased rate of finishing work and a better mass separation.

20 Claims, 12 Drawing Figures

FIG.4
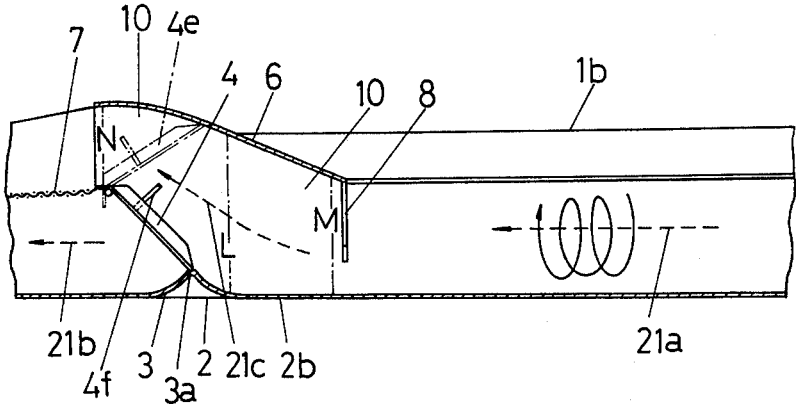
FIG.6
FIG.5
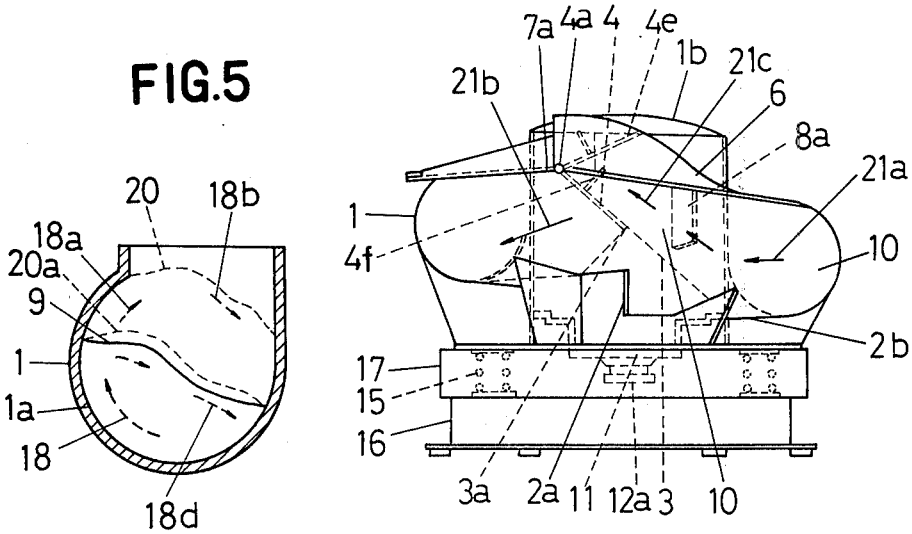

VIBRATORY FINISHING APPARATUS

BACKGROUND OF THE INVENTION

This invention relates to an improved vibratory finishing apparatus which provides both better finishing and separating functions.

In a known vibratory finishing apparatus in which finishing and separating functions are combined, there have heretofore been proposed a number of new ideas or developments. However, the known combination-type apparatus has disadvantages since its separating efficiency must be lowered so as to obtain its better finishing efficiency, and vice versa. There is also known an apparatus which provides both improved finishing and separating functions, but it involves appreciably higher manufacturing costs.

The present invention is directed to an improved apparatus by which it is possible to make effective use of the whole capacity of the tub so as to carry out the finishing work, and to complete the separating work in substantially half the conventional time, in increasing the separating capability up to 70% of the total mass, and the finishing capability to between 50% and 80%. It is therefore advantageous over the known combination-type apparatus in all respects, since its manufacturing costs are lowered by 15 to 20%, its running costs are considerably reduced as smaller vibratory forces can serve the purpose, and its running life or durability is lengthened by 20%.

SUMMARY OF THE INVENTION

The present invention provides an improved vibratory finishing apparatus with a vibratory finishing tub formed like a hollow circular annulus trough disposed in a horizontal or ascending- or descending-slope arrangement, the tub having a limited space therein which is defined by a known stationary dam of triangular shape rigidly secured on an arcuate bottom of the tub, a known movable flap member provided pivotally up and down between the stationary dam and an open end of the container leading to a mass separating device or sieve, an anti-backflow member provided on the movable flap member, two closures for controlling the flow of a mass ascending in the space, one of which is mounted on an upper opening portion of the tub between the movable flap member and stationary dam and the other of which is mounted on an upper opening portion of the tub between the point at which the mass begins to move up or enters the space and the foot of the ascending side of the stationary dam, a guiding plate of a desired form for guiding the mass into the space and preventing the backflow of the mass and so arranged, for example, that it traverses the tub radially and a vertical side extending more deeply along the inner side wall of the tub, and preferably another guiding plate of like form and arrangement is provided immediately upstream of the stationary dam. It is to be understood that the invention can be characterized by the limited space so defined in the tub, in which area an accumulated mass is formed and pushed out onto the separating device.

It is therefore one object of the present invention to provide an improved vibratory finishing apparatus which gives higher finishing and separating functions.

It is another object of the present invention to provide an economical and longer-life vibratory finishing apparatus which is manufactured at lower costs and operable at lower costs.

Other objects and advantages of the present invention will become apparent from the following specification with reference to the accompanying drawings.

BRIEF DESCRIPTION OF THE DRAWINGS

FIG. 4 is an another developed view of the apparatus showing a single guide plate 8 provided;

FIG. 5 is a sectional view of the apparatus taken along the line B B in FIG. 2, in which a guide plate 9 only is provided;

FIG. 6 is a front view of a second apparatus embodying the present invention in which the tub is arranged in a descending slope;

DESCRIPTION OF THE PREFERRED EMBODIMENTS

Figure 1:
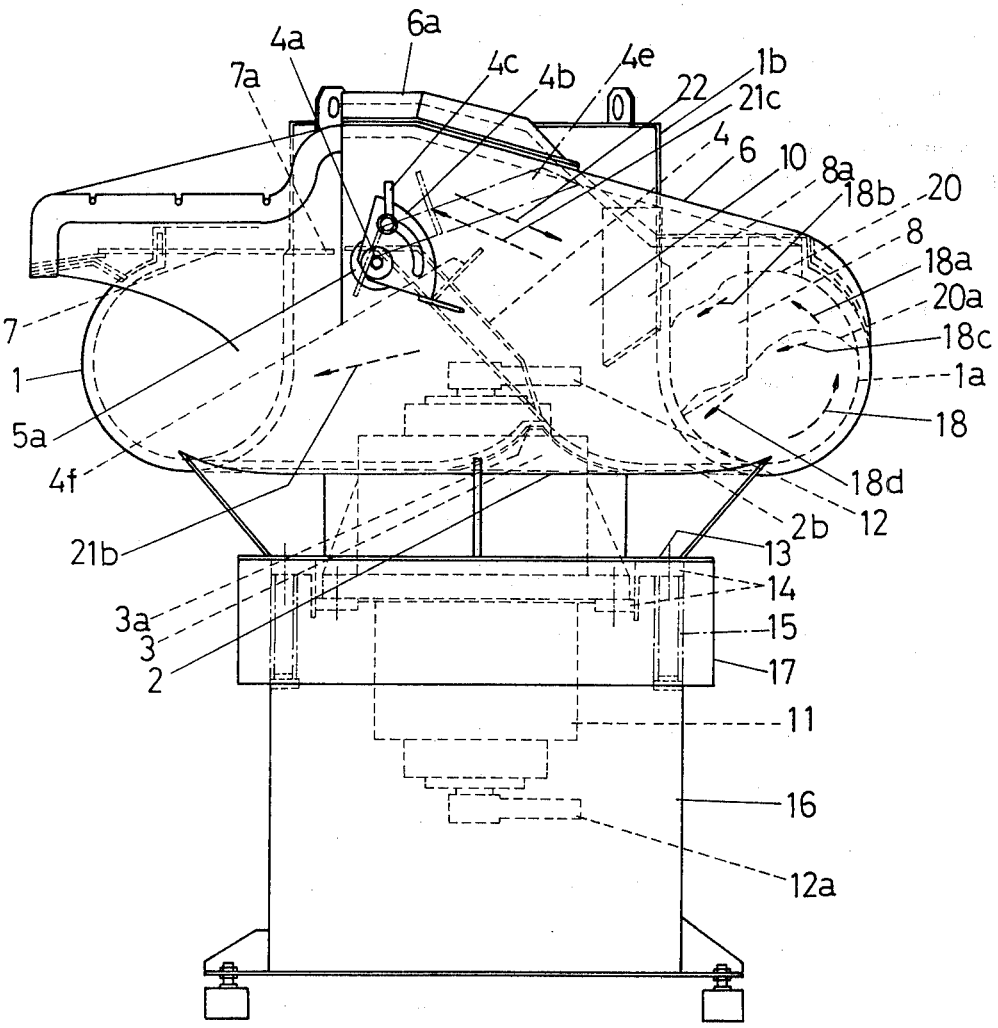
FIG. 1 is a front view of a first apparatus embodying the present invention.

The invention will now be further described by way of several preferred embodiments thereof with reference to the accompanying drawings in which:

Referring first to FIGS. 1 thru 4, there is shown a first preferred embodiment of the invention. A vibratory finishing tub or trough 1 in the form of a hollow circular annulus and open at the top has an internal bottom 2 of an arcuate cross-section which is lined with materials 1*a* such as natural or synthetic resin, for example. The tub 1 has a vacant circular center covered with a closure at the top. A vibration-generating motor 11 has a rotary shaft equipped with an unbalanced or eccentric weight 12, 12*a* at the opposite ends thereof. The motor 11 has a flanged portion securely bolted to a support 14 which is secured by means of bolts to a flanged portion 13 of the tub 1. The tub 1 and the motor 11 are thus combined and supported by a plurality of springs 15 provided between the flanged portion 13 and a machine stand 16. The motor 11 is energized to forcedly vibrate the tub 1 to impart a vibratory motion to a mass including workpieces and abrasive media (hereinafter referred to as "mass"), so that workpieces are worked, for example, by rubbing each other and/or against media.

The apparatus according to the invention has various applications such as polishing, milling, mixing, crushing, stirring or agitating, drying and the like. Media used may be of any known type depending on different applications.

As the invention has been disclosed and briefly described, the apparatus has the separating and finishing works that have been improved by providing a limited space in the tub, in which an accumulated mass is formed and forced out onto the separating device. The space is constructed so that the mass which has entered in it will move toward the separating device and never flow backward as it is pushed forward by the succeeding flow of the mass. More specifically, the space is defined by a stationary or fixed dam 3 of triangular shape, an area 2b of the arcuate bottom 2 of the tub 1 upstream of the stationary dam 3, a movable flap member 4, an open end of the tub 1 which leads to the separating device 7, two closures 6 and 6a for controlling the flow of the mass in the area, a guiding plate 8, 9, and preferably another guiding plate 8*a*, 9*a*. The guiding plate 8, 9 is located at the point where the mass is moving upwardly, and is so arranged that it is composed of vertical plate traversing the tub 1 radially and the a side having a contact with the inner wall of the tub 1 extending more deeply. The further guiding plate 8*a*, 9*a* of the same arrangement is located upstream of the stationary dam 3.

In the above embodiment, one of the two closures, shown at 6, is rigidly secured to the tub 1 for closing one opening thereof, and the other shown at 6*a* is so removably bolted to the tub 1 for closing the other opening as to be interchangeable depending on the size of workpieces. A single closure as shown at 6 in FIGS. 5 and 6 may be mounted either removably or rigidly on the tub 1.

The invention has heretofore been described with reference to the construction thereof, and it will now be clarified how the mass is accumulated and forced to flow over the stationary dam 3 to the movable flap member 4 with the anti-backflow member 4*f* and then to the separating device 7. A mass moves in a circular motion as indicated by arrows 18, 18*a* and 18*b* along the inside wall of the tub 1, flowing forward in the arrows 21, 21*a* and 21*c*. This means that the mass flows in a spiral motion in the tub 1. In principle, this holds true whether the tub 1 may be disposed in a horizontal or slope arrangement. In this manner, workpieces are subject to the finishing work by rubbing each other and/or rubbing against media.

According to the known apparatus earlier referred to, there are provided a stationary dam of triangular shape and a movable flap member located above said stationary dam. In this arrangement, a mass is forced to flow along a high slope formed by the dam and flap member so as to reach the separating device, and is therefore apt to flow backward. This usually tends to a remarkably lower separating efficiency. Furthermore, the backflow will inevitably occur whether the dam and flap member may take any form and/or arrangement as in any of the cases where only a movable flap member is provided, only a stationary dam is provided, any one of the two has a higher slope whereas the other has a lower slope, the two are provided vertically but not gradually sloped, and a stationary dam is sloped whereas a movable flap member is disposed horizontally. In any case, the backflow is inevitable as far as the mass must move up to a height (the height which does not hinder the mass flowing during the finishing work) necessary to allow the mass to reach the separating device located at the open end of the tub 1.

During the separating work, the mass moves in the arrow 18, 18*a* in FIG. 1 along the inside wall of the outer periphery of the tub 1. At this stage, the mass will never flow backward. As the mass moves further apart from the outside wall and flow toward the inside wall opposite that outside wall as shown by arrow 18*b*, it fails to move upwardly, thus causing the mass to fall down violently and directly as shown by the arrows 22, 22*a* in FIGS. 1 and 2. This backward flow continues without interruption as long as the mass flows. This results that a very small or limited amount of mass can only move beyond the movable flap member up to the separating device, thus remarkably lowering the separating efficiency. According to the known apparatus, a closure is provided for preventing the overflow of the mass, but that alone is not effective in preventing the backflow. A combination of a guide plate and a movable flap member with an anti-backflow member may effectively prevent the backflow but is not enough to prevent the overflow. Those present disadvantages in the separating efficiency and in the fact that the tub may be inclined unstably by the overflow during the separating work.

Figure 2:
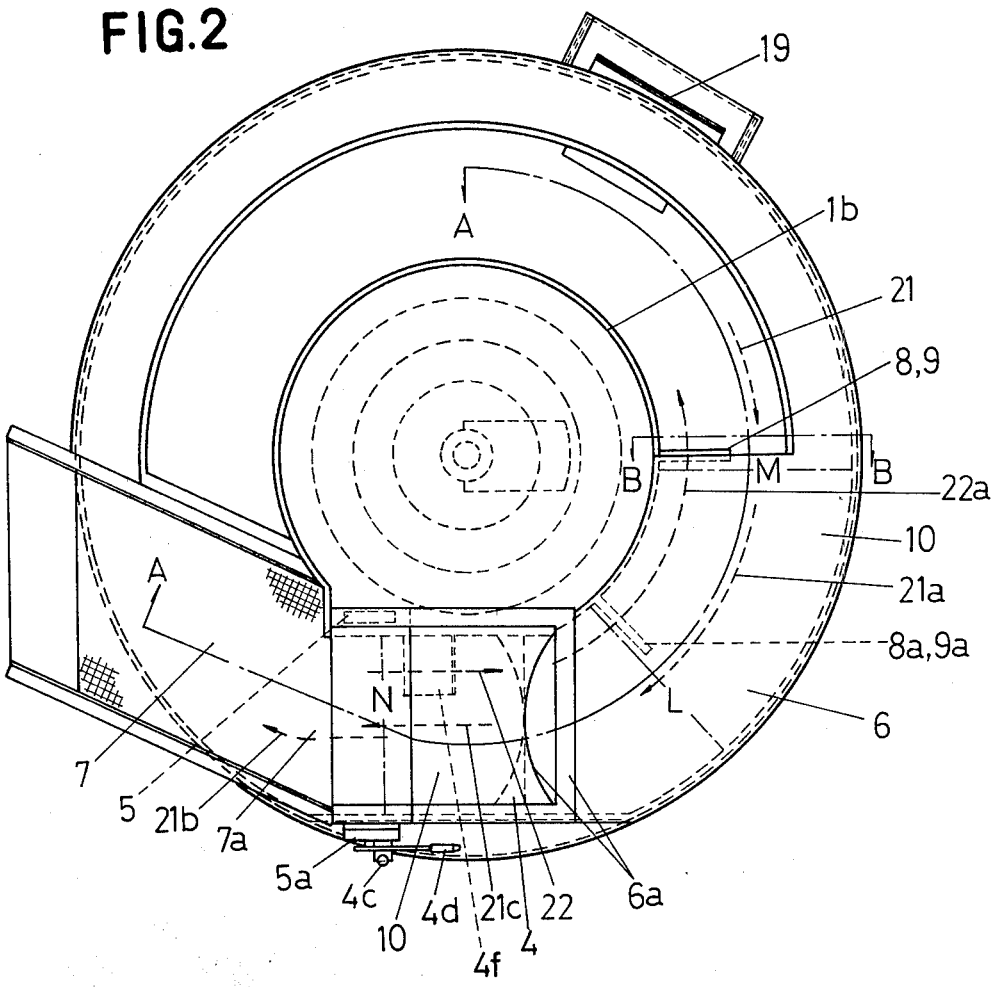
FIG. 2 is a plan view of the apparatus shown in FIG. 1.
Figure 3:
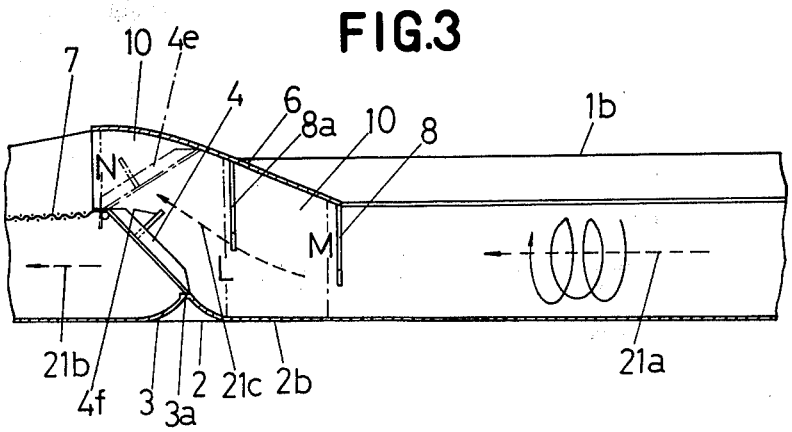
FIG. 3 is a sectional developed view of the apparatus, taken along the line A — A in FIG. 2.
Figure 7:
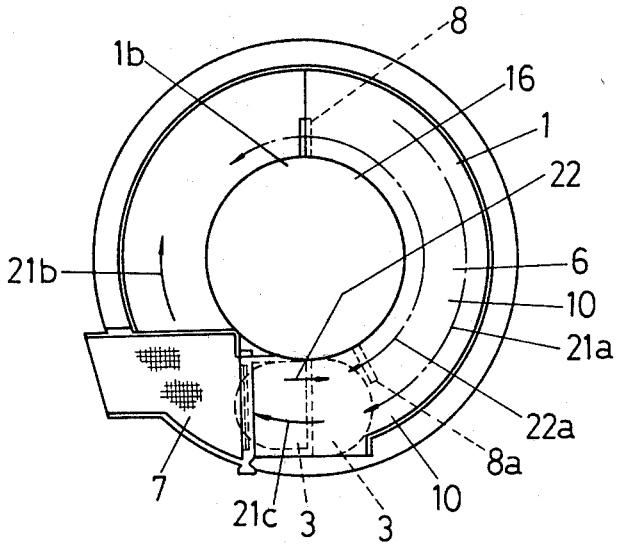
FIG. 7 is a plan view of the apparatus shown in FIG. 6.

The present invention has overcome those disadvantages by providing the limited space or region in the tub, said space being defined by closures at the top and guide plates in which an accumulated mass is formed and is continuously forwarded out of the area. The path of the mass which flows in the area is as indicated in FIGS. 2 and 3, which will be described below. The cross-sectional area L, M and N traversing radially of the tub 1 are provided in the size of $L>M>N$, so that the mass in those areas is compressed under forced vibration, and is thus forced to move upwardly toward the separating device without flowing backwardly. As the area is so arranged, the separating work has considerably improved.

A mass guiding plate shown at 8, 8*a* in FIG. 1 is so constructed that they are composed of vertical plates, each traversing the trough radially and a side extending more deeply along the inner-peripheral inside wall of the trough. There may be provided a guiding plate 9, 9*a* in FIG. 5 instead of the guiding plate 8, 8*a*, said guiding plate 9, 9*a* extending across a portion which covers the upper half of the cross-section of the trough and a side which extends more deeply along the inner-peripheral inside wall of the trough. The guiding plate 9, 9*a* serves more effectively to prevent the backflow of relatively large workpieces, for example. As best seen from FIG. 5, the guiding plate 9 is so located as to prevent the backflow of that part 20*a* of the total mass 20 which is left after the completed separation work of over 50% of the total mass 20. If the guiding plates 8 and 8*a* or 9 and 9*a* are provided, the flow of the mass forward will not be impeded by those plates during the finishing work which urges the mass to move forward. This is because the guiding plates are so designed as to blockade the path through which the mass is caused to flow backward and allow the mass to flow forward. The guide plate shown at 8 or 9 should preferably be provided as indicated in FIG. 4 for the kind or shape of the mass which easily become stiff while flowing forward, whereas to guide plates 8, 8*a* or 9, 9*a* should preferably be provided for the kind or shape of media which flow more easily. Easily stiffened media include media such as those of triangular, diamond, cylrindrical, circular or conical form, the backflow of which can effectively prevented by means of a single guiding plate 8 or 9.

Other media of globular, granular or similar form are relatively easy to flow, so that two guiding plates should be provided in order to improve both the separating and finishing works. This has turned out to be practically effective. When media such as steel balls or similar types of the greatest fluidity are used, there should preferably be provided one or more guiding plates inside the space of the trough, and one or more guiding plates should also be provided in other spaces of the trough open at the top. This arrangement has a better effect on preventing the backflow of those media.

Referring to FIGS. 1 and 2, the movable flap member 3 has a shaft supported by bearings 5, 5*a*, a plate body 4*b* controlled by a lever 4*d*, and a lever 4*c* which is passed through a longitudinal hole of the plate body 4*b* to keep the plate body 4*b* in a stationary position. The flap member 3 is thus manually operated, but may be automatically operated by means of a hydraulic or pneumatic pressure cylinder.

Figure 10:
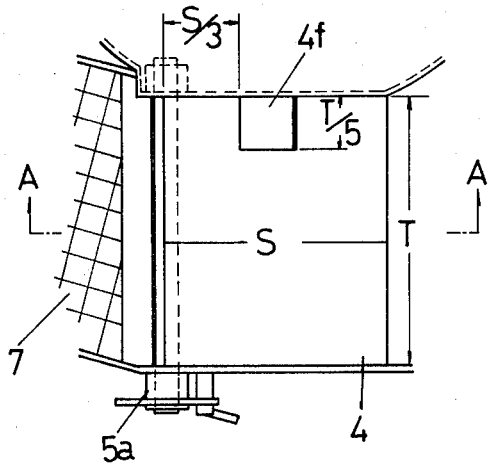
FIG. 10 is a plan view of a movable flap member of a flat face having an anti-backflow member thereon.
Figure 11:
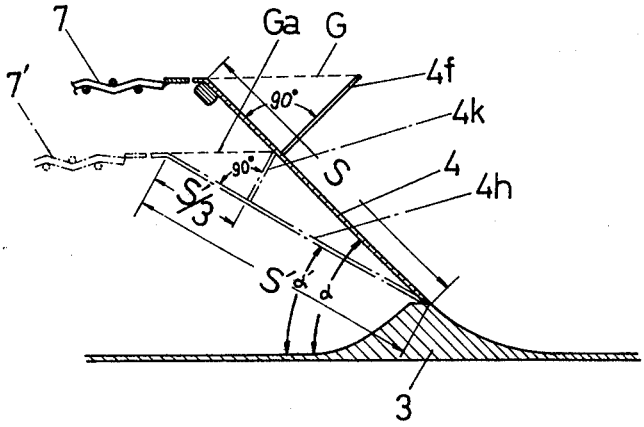
FIG. 11 is a sectional view of the movable flap member taken along the line C — C in FIG. 10, diagrammatically showing the movable flap member inclined at two different angles.
Figure 12:
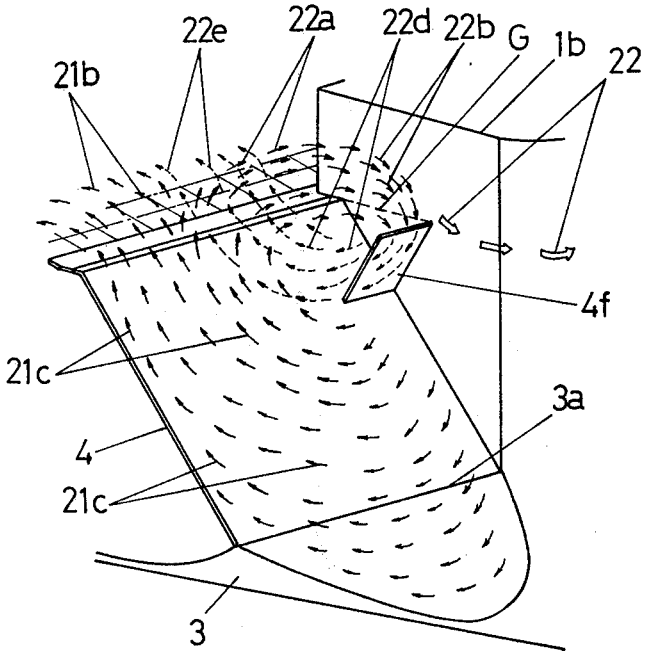
FIG. 12 is a diagram showing the manner in which the mass is flowing on the movable flap member and is prevented from flowing backward by the anti-backflow member.

Movable flap member having a concave or depressed surface shown at 4 is the most suitable for moving the mass forward and upward, but a movable flap member of plane form may be used. Whatever of those two may be used, the movable flap member should be lined with rubber or synthetic resin material, and provided with an anti-backflow member 4*f* thereon to ensure a highly effective separating work. The shaft supporting the movable flap member should preferably be provided on the side of and adjacent to the separating device. The anti-backflow member 4*f* should preferably be provided as particularly indicated in FIGS. 10 to 12, which acts as the most suitable means for preventing the backflow of the mass. It is shown in FIGS. 10 to 12 that the anti-backflow member 4*f* is provided on the movable flap member at right angle to the plane of the movable flap member, and is located closer to the inner-peripheral inside wall of the trough and at substantially one-third of the whole length S of the movable flap member down from the uppermost point of the movable flap member. The member 4*f* has a width equivalent to one-fifth of the width T of the movable flap member. A height is chosen as that the top of member 4*f* is on the same level as that of the separating device, when the movable flap member is moved down on its shaft for separating the mass as shown in FIG. 11.

It will be seen that if the separating device 7 is located in a lower position shown at 7′, the member should be lower in height as shown at 4*k* in FIG. 11, as indicated by the dotted lines G or G*a*. The movable flap member will also have an angle relative to the arcuate bottom of the trough from the angle $\alpha\ \alpha'$. This results that the length L will have to become S′. That part of the mass moving upward along the outer-peripheral wall side of the trough as indicated by the arrows 18, 18*a* in FIG. 1 is keeping on moving upward as indicated at 21*c* in FIG. 12, and that part of mass moving upward on the movable flap member closer to the inner-peripheral wall side of the trough as indicated at 18*b* in FIG. 1 fails to keep on moving upward and falls down as indicated at 22*a*, 22*b* in FIG. 12. In the latter case, anti-backflow means like the member 4*f* above described will serve to prevent the backflow of that part of mass, which will move in a different direction as shown at 22 *d* and join the part of mass shown at 21*c*. The two groups of mass so joined are going together up to the separating device 7 where they are sieved. This eliminates all possible backflow of the mass, and therefore facilitates the movement of the mass upward, so that the separating time is remarkably reduced.

The two types of apparatus which have been described and include the devices according to the invention provide a better separating effect than the same conventional type of apparatus, and have the same performance which is better than the conventional apparatus. Details of comparative experiment data will be given later.

Figure 8:
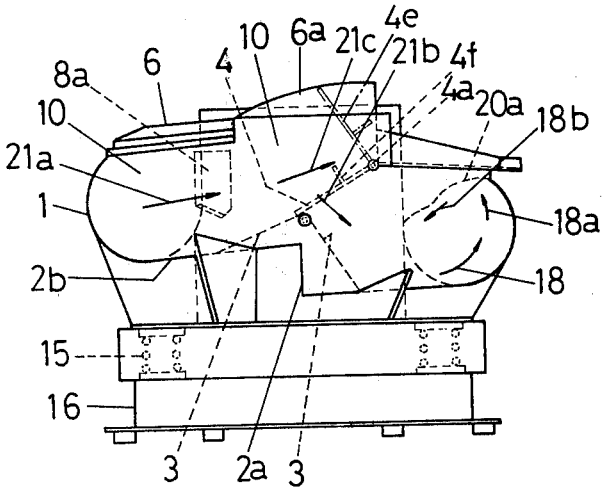
FIG. 8 is a front view of a third apparatus embodying the present invention in which the container is arranged in an ascending slope.
Figure 9:
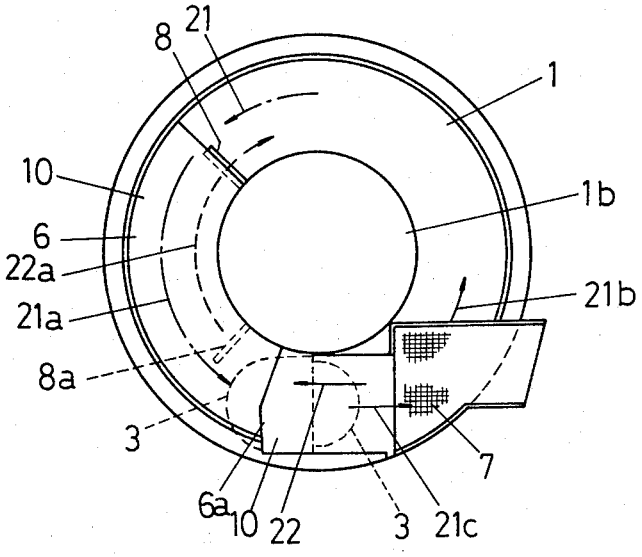
FIG. 9 is a plan view of the apparatus shown in FIG. 8.

All the types of apparatus according to the present invention have a vibratory finishing tub formed like an annular trough and open at top except the portions closed by at least one closure. This permits an easy charging of workpieces and media. Finished workpieces are discharged onto the separating or sieving device. A port 19 is also provided in order to discharge the whole mass from the tub, for instance, for exchanging the media. In FIGS. 6 to 9, there is not shown such port as shown at 19, but it should preferably be provided at the lowest bottom of the trough. More specifically, in FIGS. 6 and 7, there is shown a port preferably provided at the bottom just below the closure and in close proximity of the upstream side of the guiding plate 8*a*. In FIGS. 8 and 9, there is shown a port which is preferably provided below the separating device 7 or in close proximity of the downstream side of the device 7.

The vibratory finishing apparatus constructed according to the present invention provides the increased finishing and separating capabilities which greatly exceed those of the conventional combination-type apparatus. Those facts have been proved by experiments in which all types of apparatus were tested under the same conditions, i.e., different ranges of vibrations common to all the types. The comparative table is given hereinafter which shows the results of the experiments.

The experiments were effected to compare with the conventional finishing apparatus with a tub disposed in an ascending slope arrangement which is typical of the known combination-type apparatus and is not provided with the closures 6, 6*a* and guide plates 8, 8*a* according to the invention.

| | |
|---|---|
| Test Case I | |
| Type of apparatus | : Model CLR-200U (FIGS. 1 and 2) |
| Manufacturer | : Shikishima Tipton |
| Capacity | : 200 l |
| Number of vibrations | : 1,800 c/s |
| Amplitude | : 4.5mm vertically and 2mm laterally |
| Upper and lower weights | : 1.6 kgs (both) |
| Abrasive media | : Chipton AT-2 made by Shikishima Tipton |
| Compounds | : GCP made by Shikishima Tipton |
| Water | : a little |
| Workpieces | : Iron-made parts for sewing machine 25mm $\phi$, small quantity |
| Finishing time | : 30 minutes |
| Test Case II | |
| Type of apparatus | : Model CSR-200U (FIGS. 6 and 7) |
| Other data | : same as in case I |
| Test Case III | |
| Type of apparatus | : Model CCR-200U (FIGS. 8 and 9) |
| Other data | : same as in case I |
| Test Case IV | |
| Type of apparatus | : Model CCL-200 (conventional type which is not constructed according to the invention) |
| Other data | : same as in case I |

Comparative Table
(Finishing Performance)

| Test Case | Amplitude Vertical × Lateral (mm) | Amt. of work pieces separated from mass(%) | Separation time (min) | Amt. of workpiece to be finished comparison of finishing efficiency(%) | Roughness of finished surface(μ) |
|---|---|---|---|---|---|
| I | 4.5 × 2 | 68 | 5 | 155 | 1.7 |
| II | 3.5 × 1.5 | 62 | 5 | 182 | 1.5 |
| III | 3.5 × 1.5 | 50 | 7 | 108 | 1.5 |
| IV | 3.0 × 1.2 | 30 | 10 | 100 | 2.0 |

The guiding plates according to the present invention may be provided for the type of apparatus which has a tub wholly closed by closures, and for the type of apparatus which is called a heavy compression vibratory apparatus with a tub whose internal cross-sectional area in the radial direction is adjustable. In this manner, those two types of apparatus including the invention provide the improved means of preventing the backflow of the mass and separating the mass in addition to their respective features. It is to be understood that those means are within the technical scope of the invention.

As the invention has been illustrated with reference to the several preferred embodiments, over 50% of the total mass can be separated in less time than in the prior art. This means that the separating capability has improved to substantially 170% as compared with that of the conventional apparatus (less than 30% of the total mass) and the separating time has been reduced to substantially half the conventional time.

It should also be noted that the finishing capability of the apparatus has so remarkably increased that it can finish workpieces with higher efficiency and with improved precision.

Although the invention has been described with the several preferred embodiments, it should be understood that changes and modifications may be made without departing from the scope and spirit of the invention.

What I claim is:

1. In a vibratory finishing apparatus with a vibratory finishing tub formed like an annular trough disposed in a horizontal arrangement and including a stationary dam member of triangular shape provided on the arcuate bottom of the trough and a movable flap member provided pivotally up and down between the stationary dam member and the open end of the trough which leads to a mass separating or sieving device, an improved apparatus wherein the trough has a region provided therein for moving a mass including workpieces and abrasive media which enters said region and is accumulated under compressed vibrations forward to said mass separating device, said region being defined by said stationary dam member, said movable flap member provided with an anti-backflow member thereon, at least one closure for closing the upper open portions of the trough between a point at which the mass begins to ascend and said open end of the trough, and a mass guiding plate for allowing the mass to enter said region and preventing the backflow of said mass, said guiding plate being so provided at upstream end of said closure as to traverse said trough radially.

2. In a vibratory finishing apparatus with a vibratory finishing tub formed like an annular trough disposed in a horizontal arrangement and including a stationary dam member of triangular shape provided on the arcuate bottom of the trough and a movable flap member provided pivotally up and down between the stationary dam member and the open end of the trough which leads to a mass separating or sieving device, an improved apparatus wherein the trough has a region provided therein for moving a mass which enters said region and is accumulated under compressed vibrations forward to said mass separating device, said region being defined by said stationary dam member, said movable flap member provided with an anti-backflow member thereon, at least one closure for closing the upper open portions of the trough between a point at which the mass begins to ascend and said open end of the trough, and a plurality of mass guiding plates for allowing the mass to enter said region and preventing the backflow of said mass, one of said guiding plates being so provided at upstream end of said closure as to traverse said trough radially, and the other of the same construction as said one guiding plate being provided upstream of said stationary dam member.

3. An apparatus according to the claim 1 wherein said one guiding plate extends across a portion covering the upper half of the trough and one inner side extending more deeply along the inner-peripheral inside wall of the trough.

4. An apparatus according to the claim 2 wherein said guiding plates extend across portions covering the upper half of the trough and inner sides extending more deeply along the inner-peripheral inside wall of the trough, respectively.

5. An apparatus according to the claim 1 wherein said region comprises three different cross-sectional areas of the trough in radial direction, an upstream area of said areas being greater than a downstream area, and an intermediate area being greater than said upstream area.

6. An apparatus according to the claim 2 wherein said region comprises three different cross-sectional areas of the trough in radial direction, an upstream area of said areas being greater than a downstream area, and an intermediate area being greater than said upstream area.

7. An apparatus according to the claim 1 wherein there being two closures, one closure being rigidly secured to the trough and the other being removably mounted on the trough as to be interchangeable depending on the size of workpieces.

8. An apparatus according to the claim 2 wherein there being two closures include one closure rigidly secured to the trough and the other so removably mounted to the trough as to be interchangeable depending on the size of workpieces.

9. An apparatus according to the claim 1 wherein said movable flap member includes an anti-backflow member of a width substantially one-fifth of the width of said movable flap member and a height which places said anti-backflow member on a level with said mass separating device when said movable flap member is moved down on its axis to allow the passage of the mass for separation, said anti-backflow member rigidly provided on said movable flap member at right angle to the plane thereof and located closer to the inner-peripheral inside wall of the trough and a distance of substantially one-third of the whole length of said movable flap member down from the uppermost point of said movable flap member.

10. An apparatus according to the claim 2 wherein said movable flap member includes an anti-backflow member of a width substantially one-fifth of the width of said movable flap member and a height which places said anti-backflow member on a level with said mass separating device when said movable flap member is moved down on its axis to allow the passage of the mass for separation, said anti-backflow member rigidly provided on said movable flap member at right angle to the plane thereof and located closer to the inner-peripheral inside wall of the trough and a distance of substantially one-third of the whole length of said movable flap member down from the uppermost point of said movable flap member.

11. In a vibratory finishing apparatus with a vibratory finishing tub formed like an annular trough connected at the opposite ends thereof stepwise and disposed in a slope arrangement and including a stationary dam member of triangular shape provided at the connected ends and a movable flap member provided pivotally up and down between the stationary dam member and the open end of the trough which leads to a mass separating or sieving device, an improved apparatus wherein the trough has a region of desired cross-sectional area provided therein for forming a passage of a mass including workpieces and abrasive media entering said region and accumulated under compressed vibration and for moving said mass forward to said mass separating device, said region being defined by said stationary dam member, said movable flap member provided with an anti-backflow member thereon, at least one closure for closing the upper open portions of the trough between a point at which said mass begins to ascend and said open end of the trough, and a mass guiding plate for allowing said mass to enter said region and preventing the backflow of said mass, said guiding plate being so provided at the upstream end of said closure as to traverse said trough radially.

12. In a vibratory finishing apparatus with a vibratory finishing tub formed like an annular trough connected at the opposite ends thereof stepwise and disposed in a slope arrangement and including a stationary dam member of triangular shape provided at the connected ends and a movable flap member provided pivotally up and down between the stationary dam member and the open end of the trough which leads to a mass separating or sieving device, an improved apparatus wherein the trough has a region of desired cross-sectional area provided therein for forming a passage of a mass entering said region and accumulated under compressed vibration and for moving said mass forward to said mass separating device, said region being defined by said stationary dam member, said movable flap member provided with an anti-backflow member thereon, at least one closure for closing the upper open portions of the trough between a point at which said mass begins to ascend and said open end of the trough, and a plurality of mass guiding plates for allowing said mass to enter said region and preventing the backflow of said mass, at least one of said guiding plates being so provided at upstream end of said closure as to traverse said trough radially, and the other of the same construction as said one guiding plate being provided upstream of said stationary dam member.

13. An apparatus according to the claim 11 wherein said one guiding plate extends across a portion covering the upper half of the trough and one inner side extending more deeply along the inner-peripheral inside wall of the trough.

14. An apparatus according to the claim 12 wherein said guiding plates extend across portions covering the upper half of the trough and inner sides extending more deeply along the inner-peripheral inside wall of the trough.

15. An apparatus according to the claim 11 wherein said region comprises three different cross-sectional areas of the trough in radial direction, an upstream area of said three areas having a greater cross-sectional area than a downstream area, and an intermediate area having a greater cross-sectional area than said upstream area.

16. An apparatus according to the claim 12 wherein said region comprises three different cross-sectional areas of the trough in radial direction, an upstream area having a greater cross-sectional area than a downstream area, and an intermediate area having a greater cross-sectional area than said upstream area.

17. An apparatus according to the claim 11 wherein there are two closures, one rigidly secured to the trough and the other so removably mounted to the trough as to be interchangeable depending on the size of workpieces.

18. An apparatus according to the claim 12 wherein there are two closures, one rigidly secured to the trough and the other so removably mounted to the trough as to be interchangeable depending on the size of workpieces.

19. An apparatus according to the claim 11 wherein said movable flap member includes an anti-backflow member of a width substantially one-fifth of the width of said movable flap member and a height which places said anti-backflow member on a level with said mass separating device when said movable flap member is moved down on its axis to allow the passage of said mass for separation, said anti-backflow member being rigidly provided on said movable flap member at right angle to the plane thereof and located closer to the inner-peripheral inside wall of the trough and a distance of substantially one-third of the whole length of said movable flap member down from the uppermost position of said movable flap member.

20. An apparatus according to the claim 12 wherein said movable flap member includes an anti-backflow member of a width substantially one-fifth of the width of said movable flap member and a height which places said anti-backflow member on a level with said mass separating device when said movable flap member is moved down on its axis to allow the passage of the mass for separation, said anti-backflow member being rigidly provided on said movable flap member at right angle to the plane thereof and located closer to the inner-peripheral inside wall of the trough and a distance of substantially one-third of the whole length of said movable of said movable flap member down from the uppermost position of said movable flap member.

* * * * *